US009828881B2

(12) United States Patent
Max et al.

(10) Patent No.: US 9,828,881 B2
(45) Date of Patent: Nov. 28, 2017

(54) SEAL SUPPORT STRUCTURES FOR TURBOMACHINES

(71) Applicant: UNITED TECHNOLOGIES CORPORATION, Farmington, CT (US)

(72) Inventors: Seth A. Max, Prospect, CT (US); Anthony P. Cherolis, Hartford, CT (US); Steven D. Porter, Wethersfield, CT (US); Joshua D. Winn, Ellington, CT (US); Gregory E. Reinhardt, South Glastonbury, CT (US); Jeffrey J. Lienau, Wethersfield, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 376 days.

(21) Appl. No.: 14/662,347

(22) Filed: Mar. 19, 2015

(65) Prior Publication Data

US 2016/0376925 A1 Dec. 29, 2016

(51) Int. Cl.

| | |
|---|---|
| ***F01D 11/00*** | (2006.01) |
| ***F01D 25/28*** | (2006.01) |
| ***F01D 25/24*** | (2006.01) |

(52) U.S. Cl.

CPC ..... *F01D 25/28* (2013.01); *F01D 11/003* (2013.01); *F01D 11/006* (2013.01); *F01D 25/24* (2013.01); *F01D 25/243* (2013.01); *F05D 2220/32* (2013.01); *F05D 2230/00* (2013.01); *F05D 2230/60* (2013.01); *F05D 2240/55* (2013.01);

(Continued)

(58) Field of Classification Search

USPC ..... 415/173.7

See application file for complete search history.

(56) References Cited

U.S. PATENT DOCUMENTS 6,761,034 B2 * 7/2004 Niday ..... F01D 5/08 415/171.1

7,300,246 B2 * 11/2007 Durocher ..... F01D 25/246 415/191

(Continued)

FOREIGN PATENT DOCUMENTS

| | | |
|---|---|---|
| EP | 1348898 A1 | 10/2003 |
| EP | 1369552 A2 | 12/2003 |

OTHER PUBLICATIONS

European Search Report for Application No. EP 16 16 0942.

*Primary Examiner* — Craig Kim
*Assistant Examiner* — Jason Fountain
(74) *Attorney, Agent, or Firm* — Cantor Colburn LLP

(57) ABSTRACT

A seal support structure for a turbomachine includes a mounting portion shaped to mount to a stationary structure of a turbomachine and a cylindrical leg portion disposed on the mounting portion extending axially from the mounting portion. The cylindrical leg portion can include a radially extending flange. The flange can extend at an angle of 90 degrees from the end of the cylindrical leg portion. The flange can extend at least partially in an axial direction. The cylindrical leg portion can be formed integrally with the mounting portion. In embodiments, the cylindrical leg portion is not integral with the mounting portion, i.e., the cylindrical leg portion is a separate piece joined to the mounting portion.

20 Claims, 7 Drawing Sheets

(52) U.S. Cl.
CPC ..... *F05D 2240/60* (2013.01); *F05D 2260/97* (2013.01)

(56) References Cited

U.S. PATENT DOCUMENTS

2006/0275107 A1* 12/2006 Alvanos ..... F01D 5/085
415/110
2013/0302136 A1 11/2013 Grover et al.

* cited by examiner

SEAL SUPPORT STRUCTURES FOR TURBOMACHINES

BACKGROUND

1. Field

The present disclosure relates to seal supports for turbomachines, more specifically seal supports for high pressure turbines.

2. Description of Related Art

Traditional seal support structures for turbomachines include a conical leg portion that extends obliquely in both an axial and radial direction from a mounting portion that is configured to mount to a stationary structure of the turbomachine. The conical leg portion partially defines a boundary of a flow path for cooling flow, which is ultimately routed to the gas path of the turbomachine. A hammerhead coverplate that is connected to the shaft includes a hammerhead leg portion that defines another boundary of the flow path. When disposed adjacent to the hammerhead leg portion, the conical shape of the conical leg portion creates a recirculation zone that can lead to cooling flow recirculation therein, which can reduce the cooling effectiveness.

Such conventional methods and systems have generally been considered satisfactory for their intended purpose. However, there is still a need in the art for improved seal support structures. The present disclosure provides a solution for this need.

SUMMARY

A seal support structure for a turbomachine includes a mounting portion shaped to mount to a stationary structure of a turbomachine and a cylindrical leg portion disposed on the mounting portion extending axially from the mounting portion. The cylindrical leg portion can include a radially extending flange.

The flange can extend at an angle of about 90 degrees from the end of the cylindrical leg portion. The flange can extend at least partially in an axial direction.

The cylindrical leg portion can be formed integrally with the mounting portion. In embodiments, the cylindrical leg portion is not integral with the mounting portion, i.e., the cylindrical leg portion is a separate piece joined to the mounting portion.

The seal support structure can further include a windage shield disposed on the cylindrical leg portion and extending in a radial direction from the cylindrical leg portion. The windage shield can be formed integrally with the cylindrical leg portion.

In certain embodiments, the windage shield is annular. The windage shield can be linear in cross-section, non-linear in cross-section, or any other suitable shape. The windage shield can include a curved end portion.

The windage shield can include scalloping to allow access behind the windage shield (e.g., to access bolts that mount the mounting portion to the inner case).

A turbomachine system can include a hammerhead coverplate operatively disposed on a shaft of the turbomachine to rotate with the shaft and defining a protrusion, and a seal support structure fixed to an inner casing of the turbomachine and including a leg portion extending from a mounting portion. The leg portion can extend from the mounting portion to match the protrusion such that a flow channel of uniform cross-section can be defined between the protrusion and the leg portion. The leg portion can include a windage shield as described above.

A method includes forming a seal support structure to match the shape of the hammerhead coverplate such that a flow path of uniform cross-section is defined therebetween. The method can further include disposing a windage shield on the seal support structure to define a flow path downstream of the flow path of uniform cross-section.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
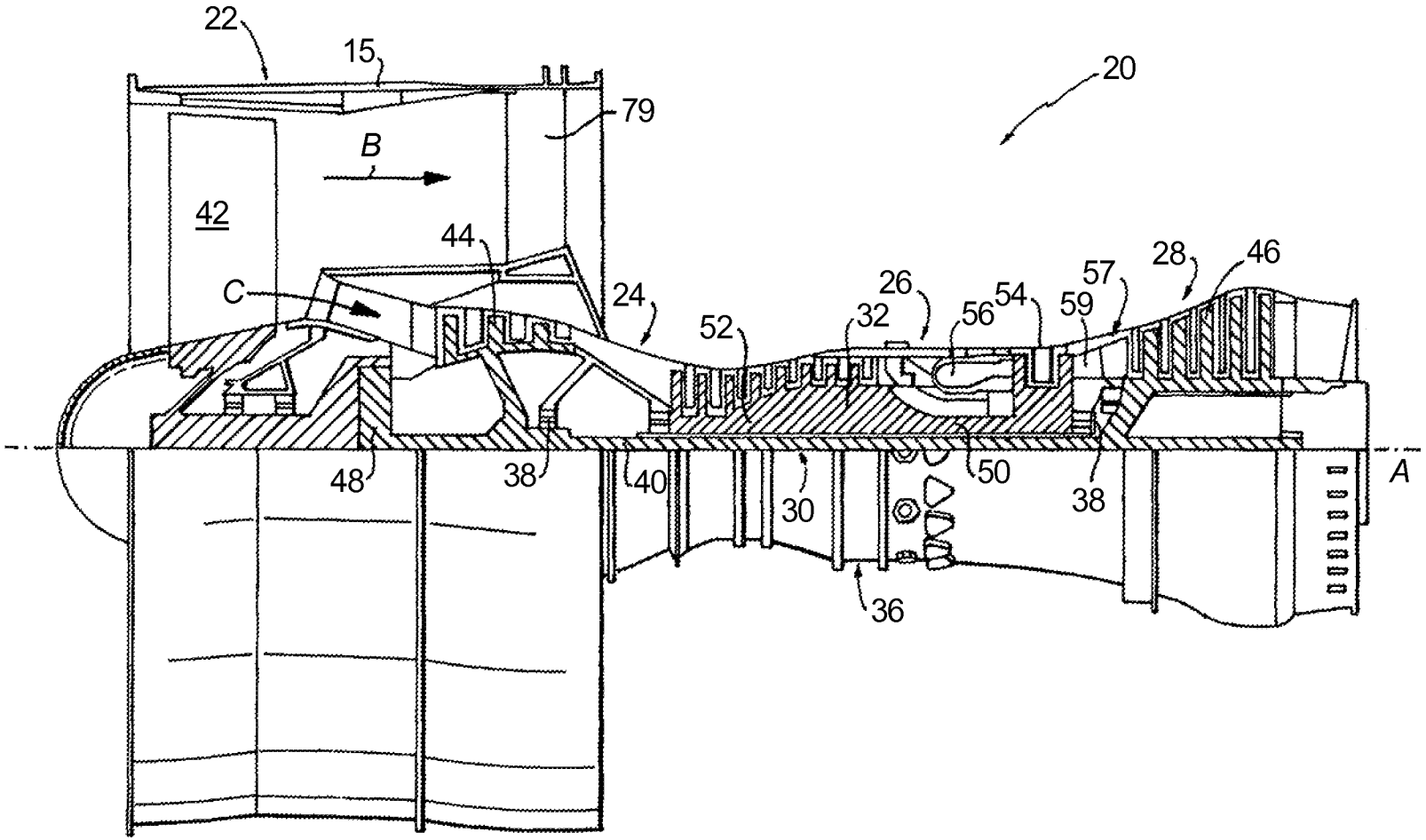
FIG. 1 is a schematic view of an embodiment of a turbomachine in accordance with this disclosure.

Reference will now be made to the drawings wherein like reference numerals identify similar structural features or aspects of the subject disclosure. For purposes of explanation and illustration, and not limitation, an illustrative view of an embodiment of a seal support structure in accordance with the disclosure is shown in FIGS. 2A and 2B and is designated generally by reference character 200. Other embodiments and/or aspects of this disclosure are shown in FIGS. 1 and 3-7. The systems and methods described herein can be used to enhance thermal efficiency in turbomachines and/or to reduce residency time of mixed air and oil vapor. Reduced residency time of potential air-oil mixtures reduces the likelihood of combustion and also reduces heat input into adjacent hardware.

Figure 2A:
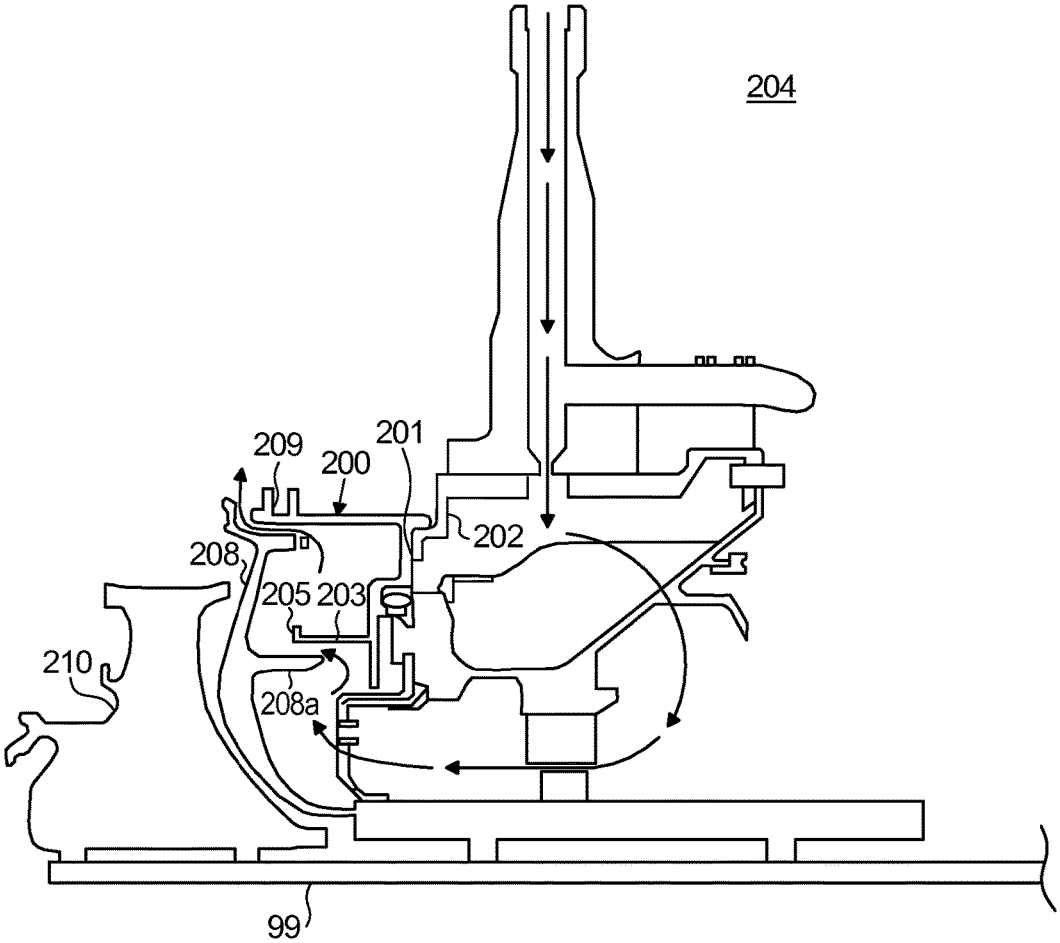
FIG. 2A is a schematic, cross-sectional view of a portion of a turbine section of a turbomachine shown including an embodiment of seal support structure in accordance with this disclosure.
Figure 2B:
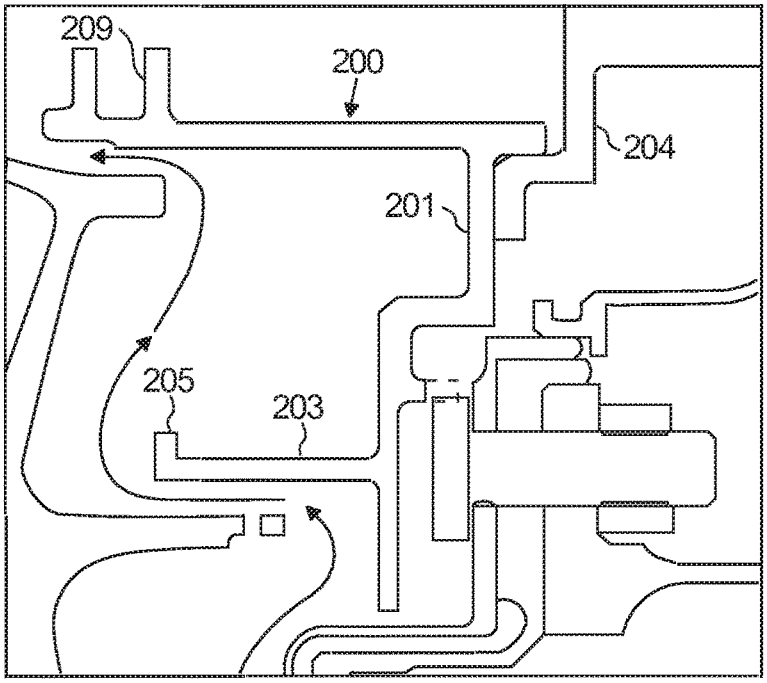
FIG. 2B is an expanded schematic view of the seal support of FIG. 2A, showing a flow path therethrough.

FIG. 1 schematically illustrates a turbomachine, such as a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a gear system 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five (5:1). Low pressure turbine 46 pressure ratio is pressure measured prior to inlet of low pressure turbine 46 as related to the pressure at the outlet of the low pressure turbine 46 prior to an exhaust nozzle. The geared architecture may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft (10,668 meters), with the engine at its best fuel consumption—also known as "bucket cruise Thrust Specific Fuel Consumption ('TSFCT')"—is the industry standard parameter of 1 bm of fuel being burned divided by 1 bf of thrust the engine produces at that minimum point. "Low fan pressure ratio" is the pressure ratio across the fan blade alone, without a Fan Exit Guide Vane 79 ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [(Tram ° R)/(518.7° R)]^0.5. The "Low corrected fan tip speed" as disclosed herein according to one non-limiting embodiment is less than about 1150 ft/second (350.5 meters/second).

Referring to FIGS. 2A and 2B, a seal support structure 200 for a turbomachine includes a mounting portion 201 shaped to mount to a stationary structure (e.g., inner case 202) of a turbomachine (e.g., in a turbine section 204). The mounting portion 201 can be annular and include any suitable number of attachment holes to allow one or more fasteners to attach the mounting portion 201 to the inner case 204. The mounting portion 201 can have a seal mount 209 attached thereto for retaining a portion of a turbine vane assembly (not shown) and/or a turbine vane seal (not shown).

The seal support structure 200 also includes a cylindrical leg portion 203 disposed on the mounting portion 201 extending axially from the mounting portion 201. In certain embodiments, the cylindrical leg portion 203 can include a radially extending flange 205. The flange 205 can extend about 90 degrees from the end of the cylindrical leg portion 203 or at any other suitable angle. For example, the flange 205 can extend at least partially in an axial direction. It is contemplated that the cylindrical leg portion 203 need not have a flange 205 at the end. The flange 205 can used to tune and/or stiffen the cylindrical leg portion 203 to eliminate vibratory responses that could cause high cycle fatigue, for example.

Figure 7:
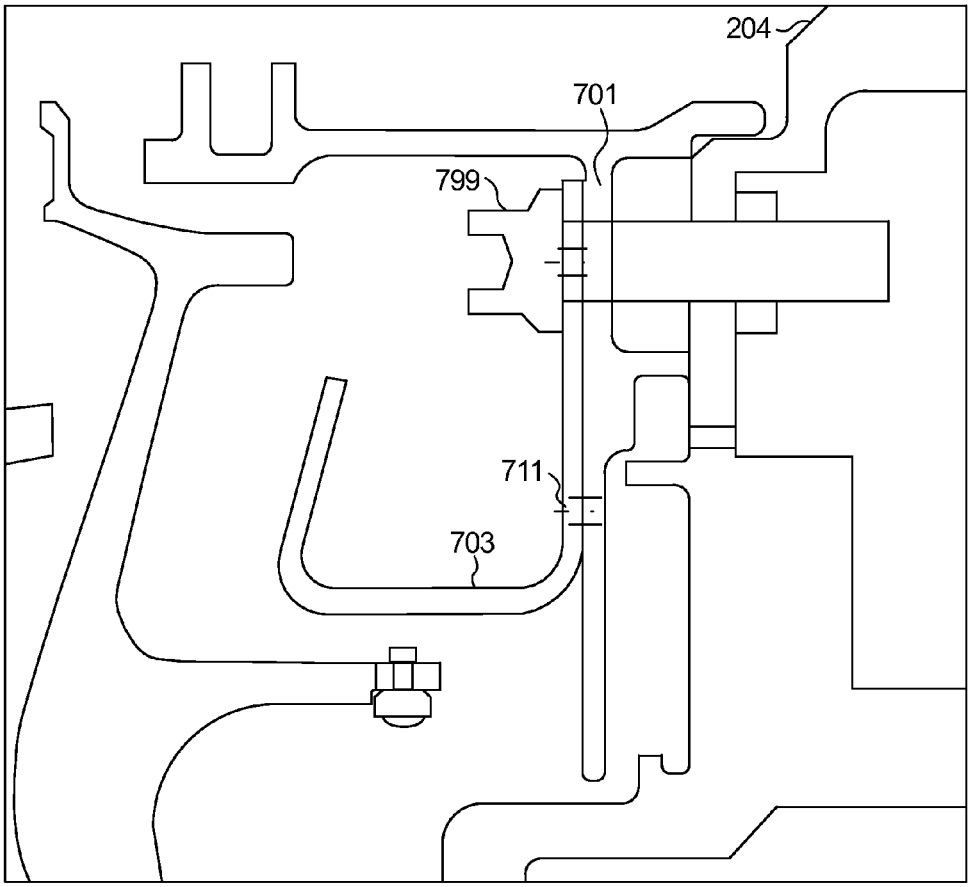
FIG. 7 is a schematic, cross-sectional view of a portion of a turbine section of a turbomachine shown including another embodiment of seal support structure in accordance with this disclosure.

As shown in FIGS. 2A and 2B, the cylindrical leg portion 203 can be formed integrally with the mounting portion 201. Referring to FIG. 7, for example, the cylindrical leg portion 703 can be non-integral with the mounting portion 701 (e.g., bolted on to the mounting portion 701 with a mounting bolt 799).

Figure 3:
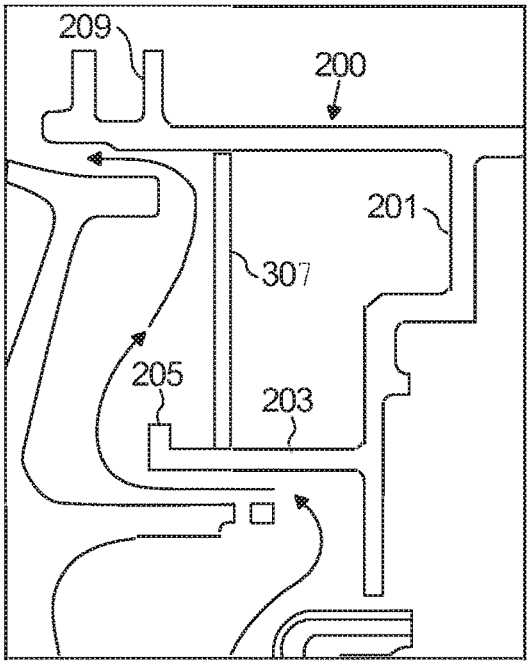
FIG. 3 is a schematic view of a portion of the seal support of FIG. 2B, showing a windage shield disposed thereon.
Figure 4:
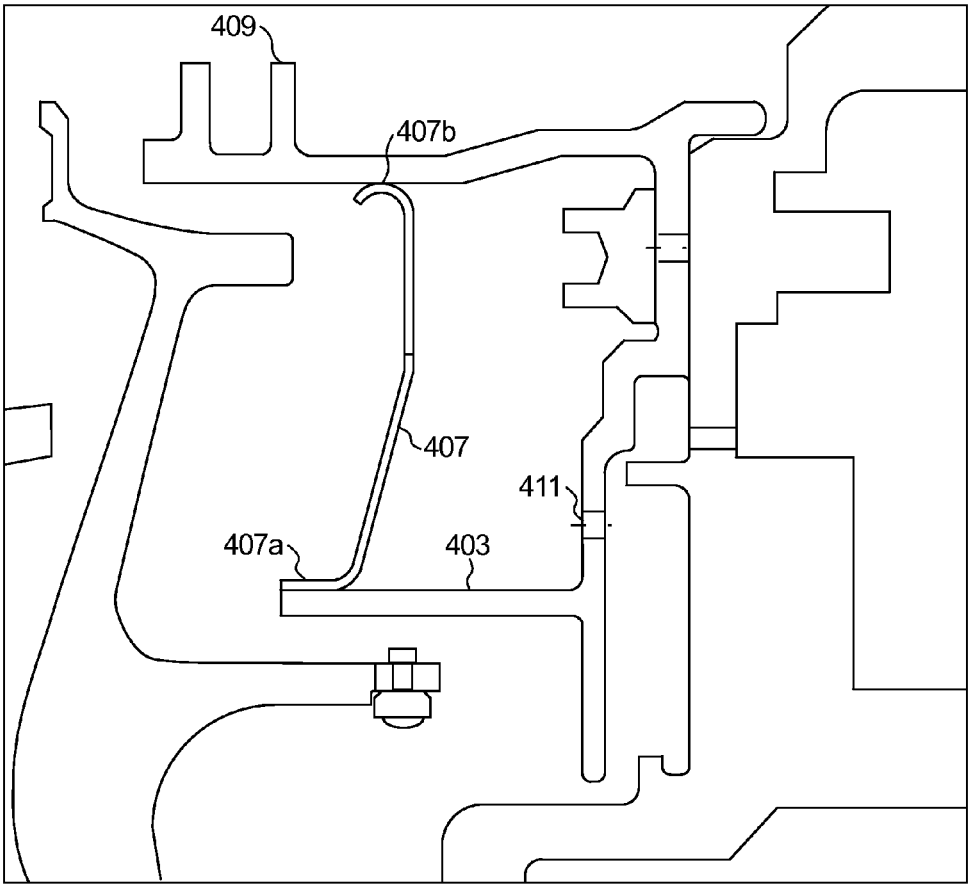
FIG. 4 is a schematic, cross-sectional view of a portion of a turbine section of a turbomachine shown including another embodiment of seal support structure in accordance with this disclosure.
Figure 5:
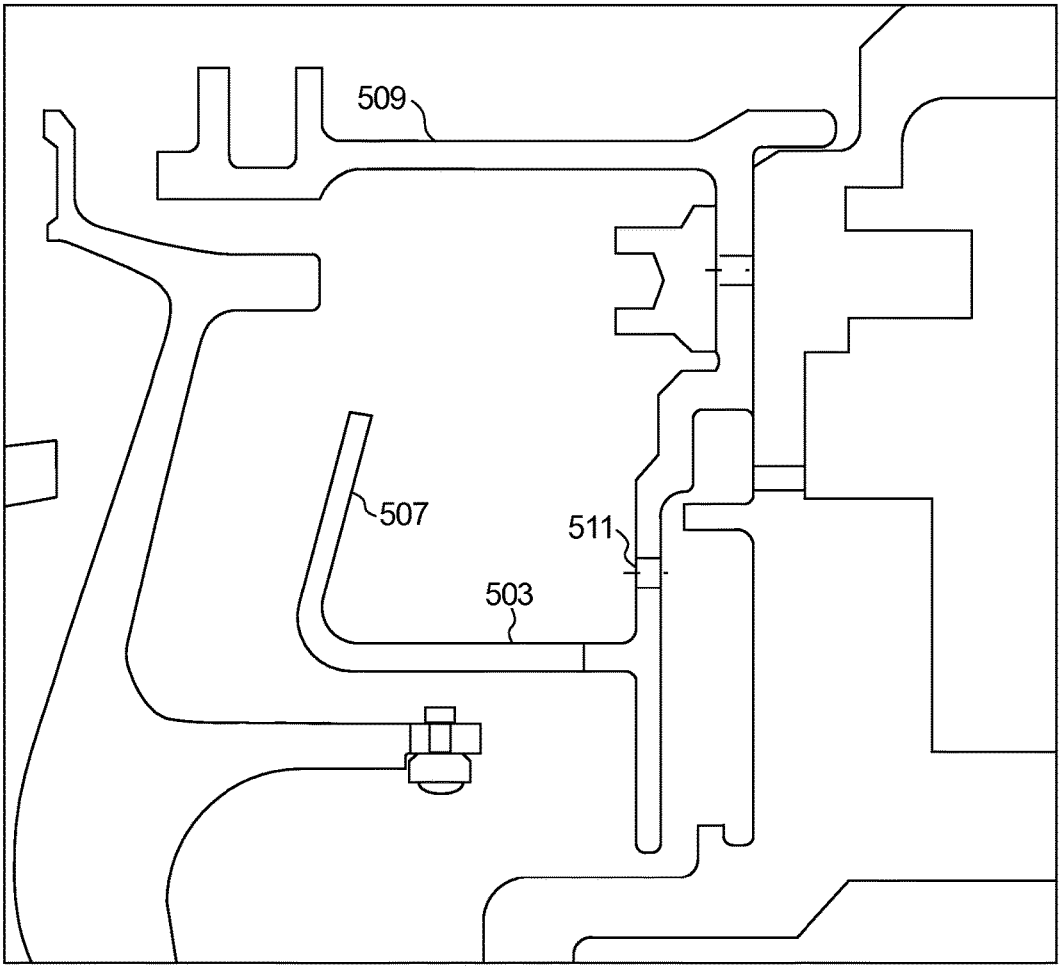
FIG. 5 is a schematic, cross-sectional view of a portion of a turbine section of a turbomachine shown including another embodiment of seal support structure in accordance with this disclosure.
Figure 6:
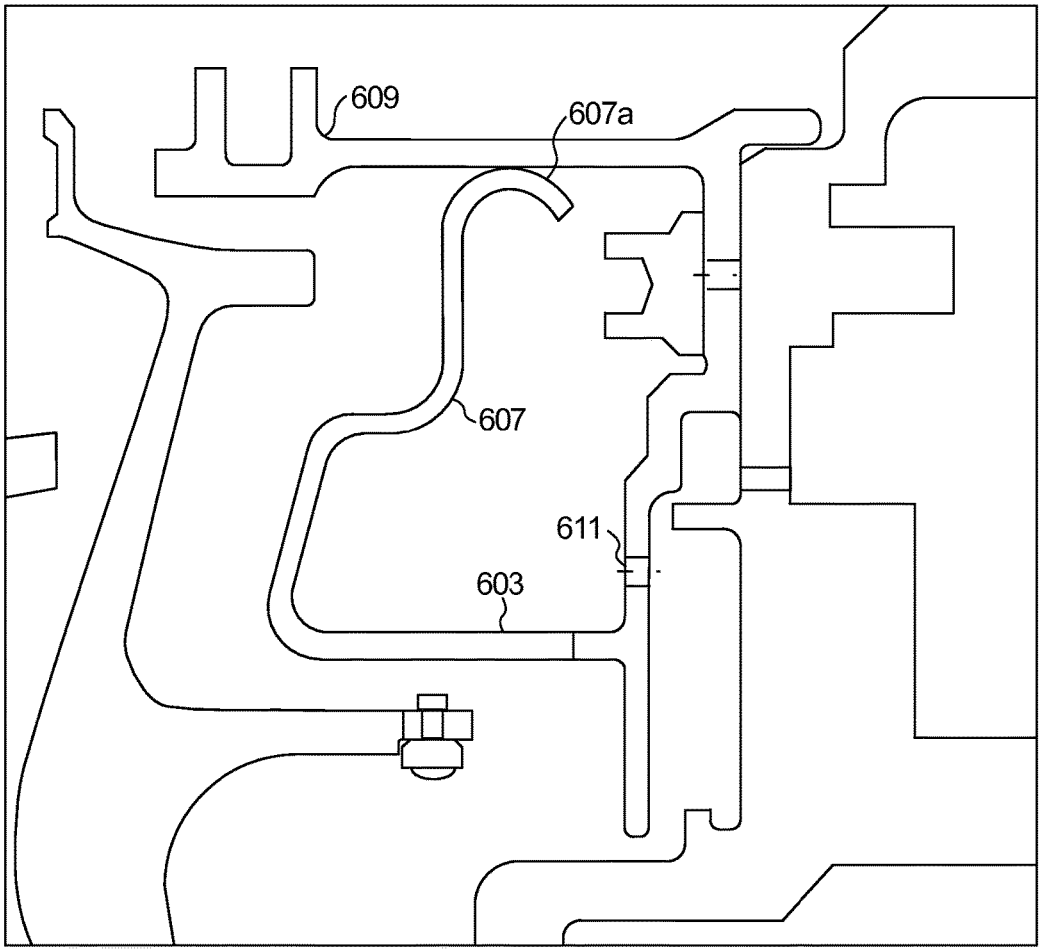
FIG. 6 is a schematic, cross-sectional view of a portion of a turbine section of a turbomachine shown including another embodiment of seal support structure in accordance with this disclosure.

Referring to FIG. 3, the seal support structure 200 can further include a windage shield 307 disposed on the cylindrical leg portion 203 and extending in a radial direction from the cylindrical leg portion 203. The windage shield 307 can extend from the cylindrical leg portion 203 up to the seal mount 209 (e.g., as shown in FIGS. 3, 4 and 6), or partially toward the seal mount 209 (e.g., as shown in FIGS. 5 and 7). The windage shield 307 can be a separate piece (e.g., an annular plate of sheet metal) that can be disposed around the cylindrical leg portion 203. In certain embodiments, the windage shield 307 can be formed integrally with the cylindrical leg portion 203.

In certain embodiments, the windage shield 307 is annular. However, it is contemplated that the windage shield 307 could be segmented or not entirely annular and/or can include holes therein. For example, it is contemplated the one or more windage shields as described herein can include scalloping at an end portion thereof that contacts an underside of the seal mount 209 such that an area behind the windage shield 307 can be accessed in certain portions (e.g., to access bolts that mount the mounting portion 201 to the inner case 204).

The windage shield 307 can include a straight cross-sectional shape as shown in FIG. 3, however, any other suitable shape is contemplated herein. For example, FIG. 4 shows a windage shield 407 disposed around the cylindrical leg portion 403 and having a non-linear cross-section that defines a collar portion 407*a* that interfaces with the cylindrical leg portion 403 and an end portion 407*b* with a bend that interfaces with an underside of the seal mount 409. In certain embodiments, the collar portion 407*a* can be welded or brazed onto the cylindrical leg portion 403. It is contemplated that the end portion 407*b* and/or the collar portion 407*a* can be sized and shaped to allow for a radial preloading when installed (e.g., to dampen vibration).

Referring to FIG. 5, a windage shield 507 can be integrally formed from the cylindrical leg portion 503, extend partially toward the seal mount 509, and can have a cross-section that defines an angle with the cylindrical leg portion 503 of the seal mount 509. In certain embodiments, the integrally formed windage shield 507 can be a separately machined piece that is connected by, e.g., a weld joint, to a protruding cylindrical leg portion 503.

Referring to FIG. 6, a windage shield 607 can be integrally formed from or attached (e.g., via a weld joint) to the cylindrical leg portion 603, interface with an underside of the seal mount 609 at end 607*a*, and can have an irregular cross-section that forms a winding path from the cylindrical leg portion 603 to the seal mount 609. For example, the end 607*a* can include a bend. It is contemplated that end 607*a* can be sized and/or shaped to allow radial preloading to reduce vibration.

Referring to FIGS. 4-7, an oil weep aperture 411, 511, 611, and 711 can be defined in the mounting portion 403 and/or the cylindrical leg portion 303 in order to prevent pooling of any oil or other fluid that may collect there (e.g., behind the one or more of the above described windage shields). It is contemplated that windage shields 307, 407, 507, 607 as described herein can have cross-sections that are linear, non-linear, or any other suitable shape and/or size.

Referring again to FIGS. 2A and 2B, a turbomachine system can include a hammerhead coverplate 208 operatively disposed on a shaft 99 of the turbomachine to rotate with the shaft 99 and a blade rotor 210. The hammerhead coverplate 208 can define a protrusion 208*a*. The turbomachine system can include a seal support structure as described above. The leg portion 205 can extend from the mounting portion 201 to match the protrusion 208*a* such that a flow channel having a uniform cross-section can be defined between the protrusion 208*a* and the leg portion 203. The leg portion 203 can include a suitable windage shield as described above. While the leg portion 203 has been described above as cylindrical, it is contemplated that the shape of the leg portion 203 can be any suitable shape to parallel the protrusion 208*a* of the hammerhead coverplate 208.

A method includes determining a shape of a hammerhead coverplate 208 in a turbomachine and forming a seal support structure 200 to match the shape of the hammerhead coverplate 208 such that a uniform flow path is defined therebetween. The method can further include disposing a windage shield 207 on the seal support structure 200 to define a flow path downstream of the uniform flow path.

The methods and systems of the present disclosure, as described above and shown in the drawings, provide for seal support structures and turbomachines with superior properties including enhanced cooling flow systems. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. A seal support structure for a turbomachine, comprising;

a mounting portion having an outer portion that is radially extending and an inner portion that is radially extending and offset in a first axial direction from the outer portion, the mounting portion shaped to mount to a stationary structure of the turbomachine;

a seal mount disposed on the mounting portion and extending in the first axial direction from the outer portion of the mounting portion;

a leg portion disposed on the mounting portion extending in the first axial direction from the inner portion of the mounting portion, the leg portion having an axial outer portion that is offset in the first axial direction from the inner portion of the mounting portion; and a windage shield disposed on the axial outer portion of the leg portion, the windage shield extending in a radial direction from the leg portion toward the seal mount.

2. The seal support structure of claim 1, wherein the leg portion includes a radially extending flange.

3. The seal support structure of claim 2, wherein the flange extends at an angle of about 90 degrees from the end of the leg portion.

4. The seal support structure of claim 3, wherein the flange extends at least partially in an axial direction.

5. The seal support structure of claim 1, wherein the leg portion is formed integrally with the mounting portion.

6. The seal support structure of claim 1, wherein the leg portion is not integral with the mounting portion.

7. The seal support of claim 1, wherein the windage shield is formed integrally with the leg portion.

8. The seal support of claim 7, wherein the windage shield is linear in cross-section.

9. The seal support of claim 7, wherein the windage shield is non-linear in cross-section.

10. The seal support of claim 1, wherein the windage shield is annular.

11. The seal support of claim 1, wherein the windage shield includes a curved end portion.

12. The seal support structure of claim 1, wherein at least one of the seal mount and the leg portion is cylindrical.

13. A turbomachine system, comprising:

a hammerhead coverplate operatively disposed on a shaft of the turbomachine to rotate with the shaft and defining a protrusion; and a seal support structure comprising:

a mounting portion having an outer portion that is radially extending and an inner portion that is radially extending and offset in a first axial direction from the outer portion, the mounting portion shaped to mount to a stationary structure of a turbomachine;

a seal mount that disposed on the mounting portion and extending in the first axial direction from the outer portion of the mounting portion;

a leg portion disposed on the mounting portion extending in the first axial direction from the inner portion of the mounting portion, the leg portion having an axial outer portion that is offset in the first axial direction from the inner portion of the mounting portion; and a windage shield disposed on the axial outer portion of the leg portion, the windage shield extending in a radial direction from the leg portion toward the seal mount;

wherein the leg portion extends from the mounting portion to match the protrusion such that a flow channel having a uniform cross-section is defined between the protrusion and the leg portion.

14. The system of claim 13, wherein the windage shield is formed integrally with the leg portion.

15. The system of claim 13, wherein the windage shield is annular.

16. The system of claim 14, wherein the windage shield is linear in cross-section.

17. The system of claim 13, wherein at least one of the seal mount and the leg portion is cylindrical.

18. A method, including forming a seal support structure to match a shape of a hammerhead coverplate such that a flow path of uniform cross-section is defined therebetween, the seal support structure comprising:

a mounting portion having an outer portion that is radially extending and an inner portion that is radially extending and offset in a first axial direction from the outer portion, the mounting portion shaped to mount to a stationary structure of a turbomachine;

a seal mount disposed on the mounting portion and extending in the first axial direction from the outer portion of the mounting portion;

a leg portion disposed on the mounting portion extending in the first axial direction from the inner portion of the mounting portion, the leg portion having an axial outer portion that is offset in the first axial direction from the inner portion of the mounting portion; and a windage shield disposed on the axial outer portion of the leg portion, the windage shield extending in a radial direction from the leg portion toward the seal mount.

19. The method of claim 18, wherein the windage shield on the seal support structure to defines a flow path downstream of the flow path of uniform cross-section.

20. The method of claim 18, wherein at least one of the seal mount and the leg portion is cylindrical.

* * * * *